United States Patent [19]

Hollenberg et al.

[11] Patent Number: 5,020,552

[45] Date of Patent: Jun. 4, 1991

[54] EXPANDABLE HAIR CURLER

[75] Inventors: Detlef Hollenberg, Hilden; Hans Schneider, Schwalmtal; Georg Weihrauch, Kreidach, all of Fed. Rep. of Germany

[73] Assignee: Henkel Kommanditgesellschaft auf Aktien, Duesseldorf-Holthausen, Fed. Rep. of Germany

[21] Appl. No.: 380,935

[22] Filed: Jul. 17, 1989

Related U.S. Application Data

[62] Division of Ser. No. 921,653, Oct. 21, 1986, Pat. No. 4,856,542.

[30] Foreign Application Priority Data

Oct. 21, 1985 [DE] Fed. Rep. of Germany ..... 3537374
Dec. 14, 1985 [DE] Fed. Rep. of Germany ..... 3544275

[51] Int. Cl.[5] ..... A45D 2/24

[52] U.S. Cl. ..... 132/265; 132/248; 132/253

[58] Field of Search ..... 132/265, 250, 253, 248

[56] References Cited

U.S. PATENT DOCUMENTS

| | | | |
|---|---|---|---|
| 1,199,550 | 9/1916 | Herrmann | 132/265 |
| 2,290,578 | 7/1942 | Boals | 132/237 |
| 2,415,586 | 2/1947 | Grant | 132/249 |
| 2,474,449 | 6/1949 | Whyte | 132/265 |
| 2,753,874 | 7/1956 | Brancaccio | 132/250 |
| 2,853,080 | 9/1958 | Brancaccio | 132/250 |
| 2,853,081 | 9/1958 | Brancaccio | 132/250 |
| 2,860,645 | 11/1958 | Brancaccio et al. | 132/250 |
| 3,495,601 | 2/1970 | Garrett | 132/237 |
| 3,583,406 | 6/1971 | Rios | 132/265 |
| 4,456,020 | 6/1984 | van Deursen | 132/265 |

*Primary Examiner*—Cary E. Stone
*Attorney, Agent, or Firm*—Ernest G. Szoke; Wayne C. Jaeschke; Real J. Grandmaison

[57] ABSTRACT

A radially expandable hair curler comprising a generally cylindrical hollow body, a detachable holding strap stretching from one longitudinal end of the body to the other, and internal mechanical devices for expanding and contracting the curler body.

4 Claims, 15 Drawing Sheets

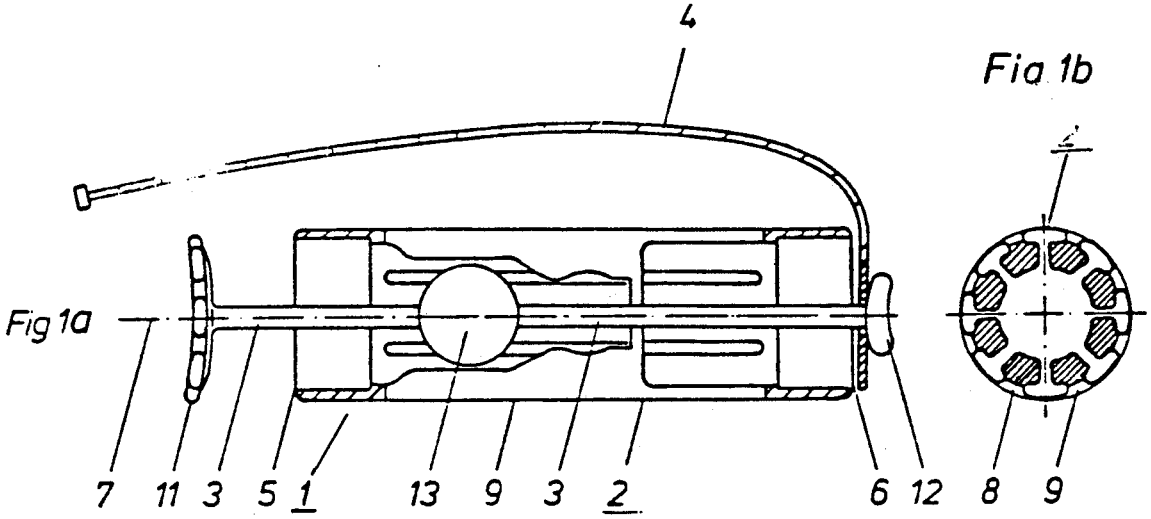
Fig 1a
Fig 1b
4
7
11
3
5
1
13
9
3
2
6
12
8
9
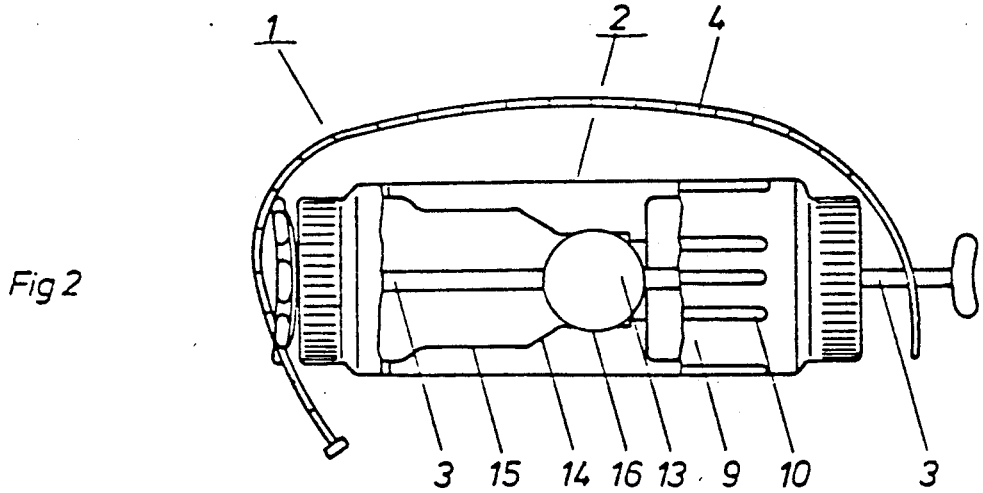
Fig 2
1
2
4
3
15
14
16
13
9
10
3
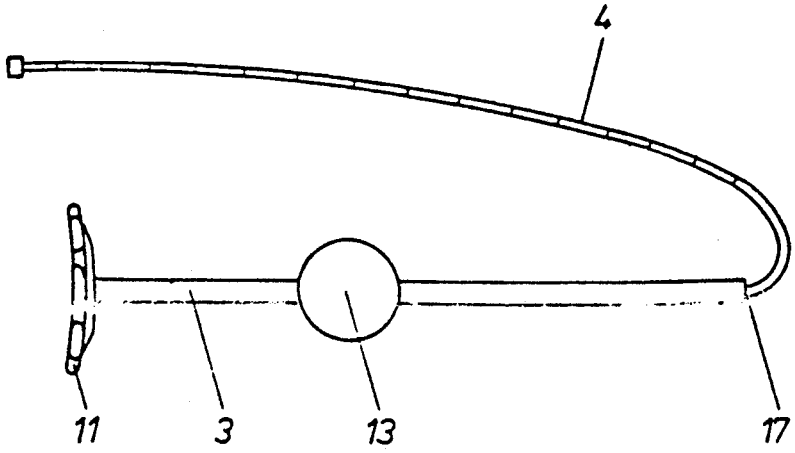
4
11
3
13
17

Fig. 8
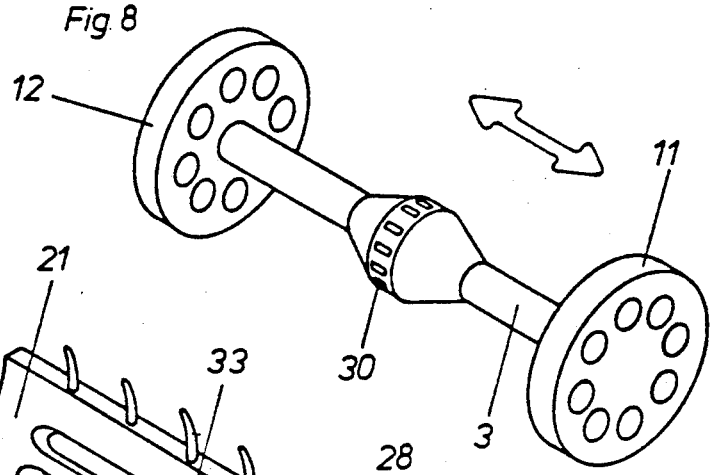
Fig. 7
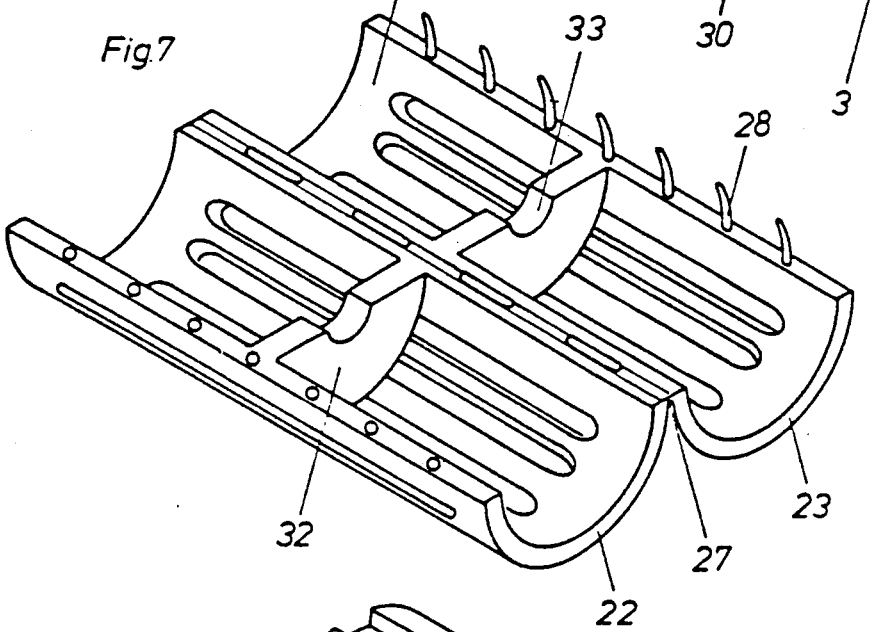
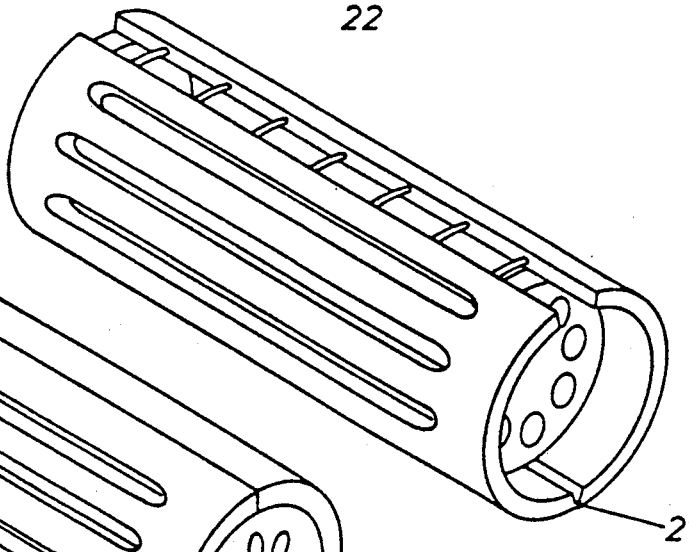
Fig. 9
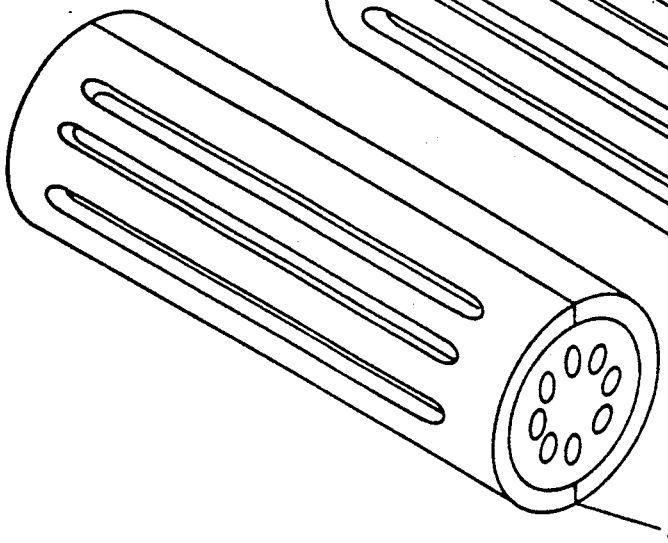
Fig. 10

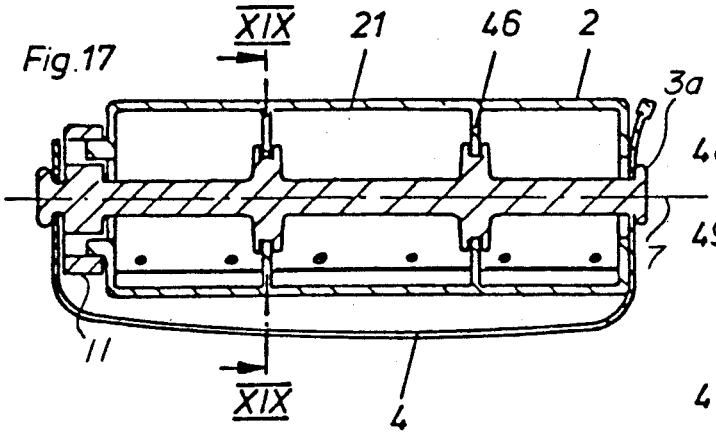
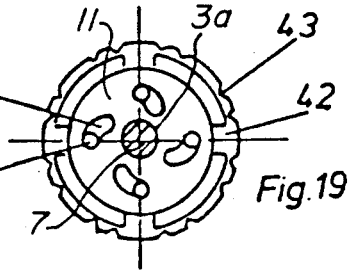
Fig.19
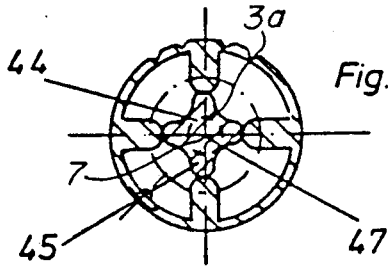
Fig.19a
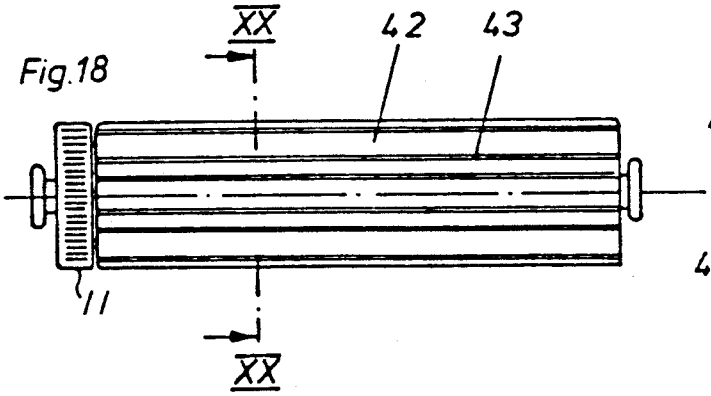
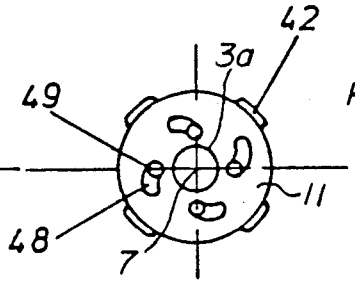
Fig. 20
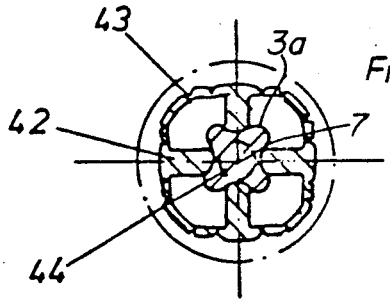
Fig. 20 a

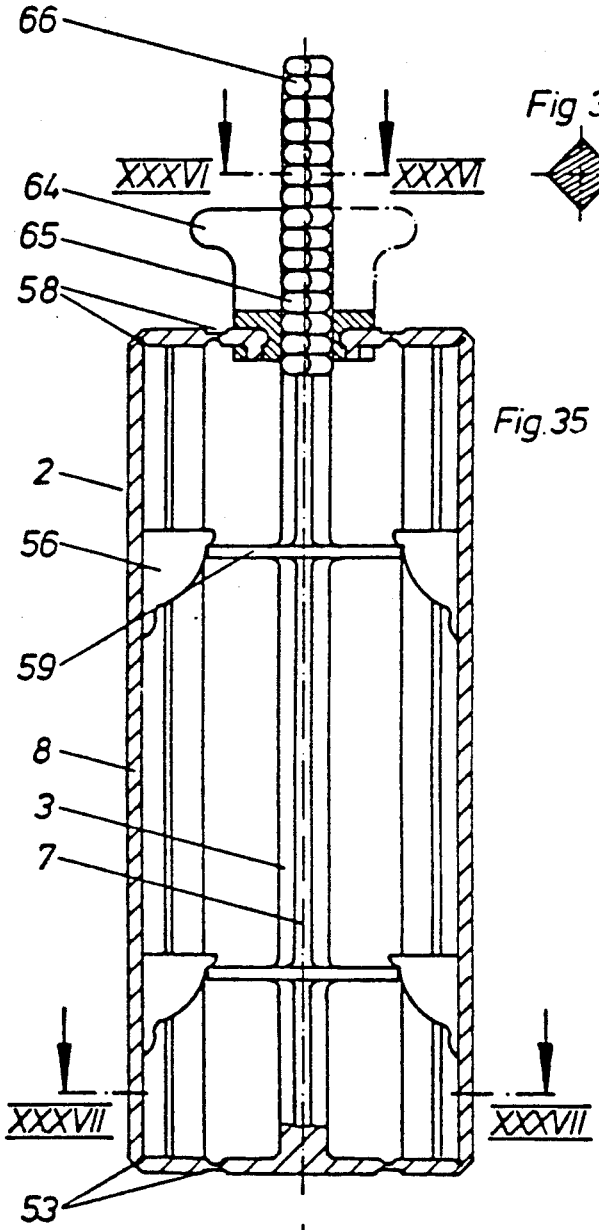
Fig 36
Fig.35
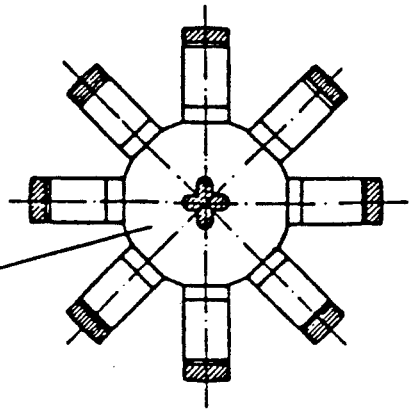
Fig. 37
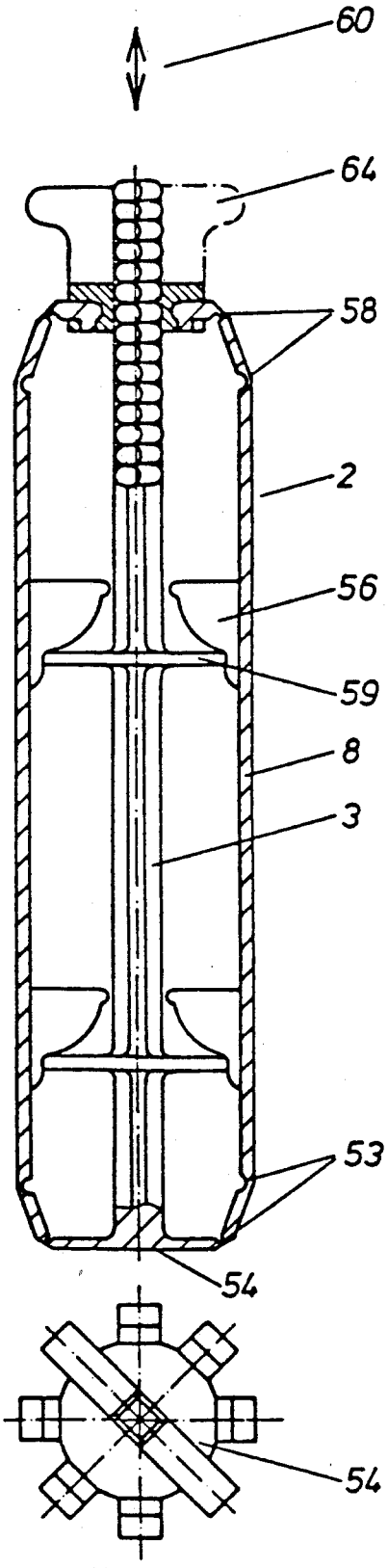
Fig.38
Fig.39

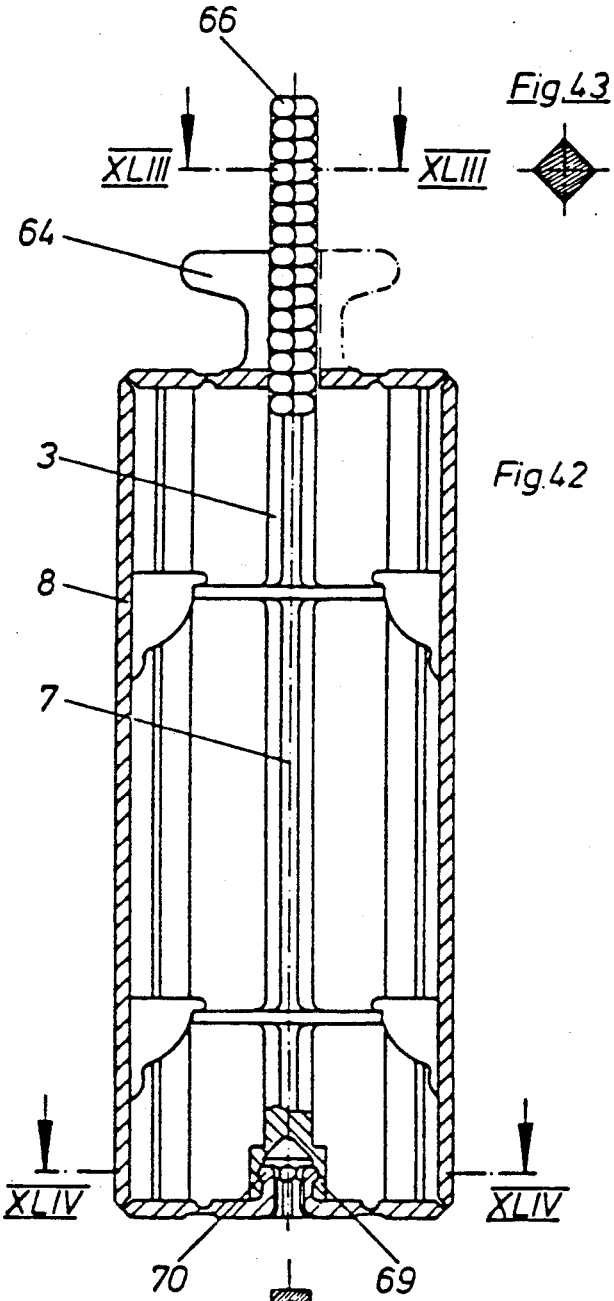
Fig.43
Fig.42
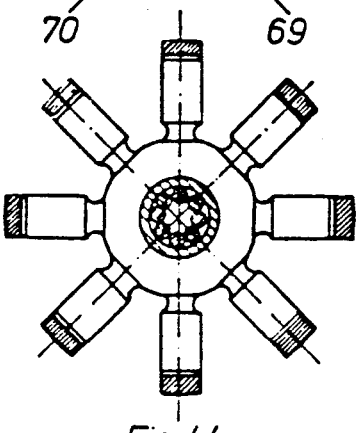
Fig.44
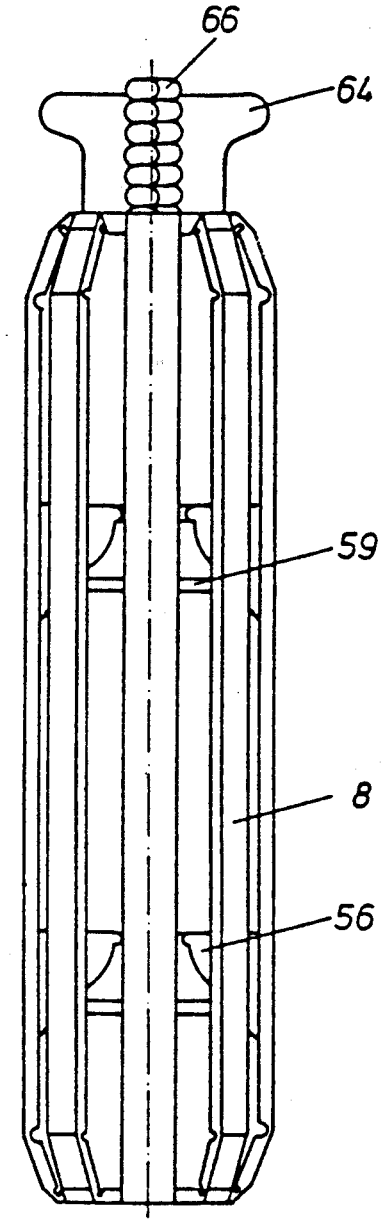
Fig.45
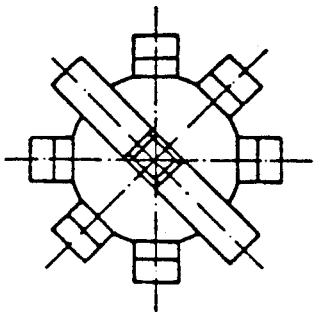
Fig.46

EXPANDABLE HAIR CURLER

This application is a division of application Ser. No. 06/921,653, filed Oct. 21. 1986, now U.S. Pat. No. 4,856,542.

BACKGROUND OF THE INVENTION

1. Field of the Invention

This invention relates to a hair curler in the form of a cylinder whose circumference can be expanded and reduced, having a holding strap stretching from one end to the other which is detachable at least at one end. This invention also relates to a method for using the hair curler comprising winding hair around the hair curler while it is in an expanded state, permitting the hair to set, and removing the curler by first reducing its circumference, and then sliding the curler axially from the hair without disturbing the curl.

2. Statement of Related Art

Conventional hair curlers, known as water wave curlers, comprise a metal cylinder of constant diameter with a brush inserted therein or an irregularly surfaced or flocked plastic cylinder. The hair is fixed by holding pins known as "postiches". The curlers are twisted into the wet hair from the hair ends toward the scalp and, after the hair has set by drying, are untwisted in the opposite direction. The removal of the curlers is time consuming and sometimes painful due to tangled hair, and, unless properly done, may even lead to partial destruction of the curls.

SUMMARY OF THE INVENTION

This invention provides a curler which may readily be removed from the hair at considerably less risk of disturbing the curls after they have set. Broadly, the curler comprises a cylindrical body having an adjustable circumference, internal means for effecting such adjustment, and at least partially attached means for holding the curler in place while the hair is setting. This invention also provides methods for using the curler comprising expanding the circumference of the curler, winding hair around the curler starting at the end of the hair and moving toward the scalp, holding the curler in place until the curl is set, reducing the circumference of the curler, and sliding it axially out from the curl.

The setting of the hair may be effected in any conventional manner, for example by curling wet hair, or by wetting the hair after dry curling. Any suitable curling lotion may be used, including simple water. Any suitable drying means may be used, including exposure to the ambient atmosphere, or the application of heat or radiation. None of these parameters comprise part of this invention, since all are conventional.

The bodies of curlers according to this invention should have a generally cylindrical configuration. For the purposes of this invention, a "cylinder" is not limited to an object having a circular section perpendicular to its central axis, but also includes objects having polygonal or even irregular cross-sections, provided that the overall configuration of the object is generally cylindrical so that it can serve as a hub about which hair can be curled.

For variation of its circumference, the curler body according to this invention may comprise as its outer skin, a material elastically stretchable in the circumferential direction. Suitable for this purpose is an elastic skin of plastic or rubber, which may even contain holes to allow air through, on a support capable of being mechanically expanded and contracted in the radial direction. However, the curler body may also comprise an essentially flexible, basically cylindrical element with at least one dividing partition extending parallel to its axis from one end to the other. In this case, the means for increasing or reducing the circumference of the curler body may comprise forcing the curler body apart from inside and thus enlarging the gap along the partition. To reduce the circumference of such a curler body, it is merely necessary to relax the force acting from inside so that the curler body reassumes its original form.

In addition, the curler body may be made of partial circumference shells (cylinders) or the like delimited by longitudinally extending partitions. The shells may be butted, tongue-and-grooved or intermeshed along the parting lines and/or joined by a hinge or the like. It has proven to be favorable to make the curler body in the form of a one-piece injection molding comprising four quarter-circumference shells and three longitudinally arranged hinges. The curler body may also be composed with advantage of a plurality of bar lamellae which are arranged axially parallel to one another and to the longitudinal axis of the curler and which are held together with play (in the peripheral direction of the curler) so that the circumference of the curler body can be made variable.

According to the invention, the means for expanding and collapsing the curler body are adjustments inside the curler body or at one or both open ends of the cylindrical element. A plunger located along the cylinder's longitudinal axis and guided within the curler body designed to be actuated from at least one end thereof, and means co-operating with the plunger for expanding or contracting the circumference or diameter of the curler body, are preferably provided. By arranging the actuating means so that they may be manipulated from the longitudinal ends of the curler body, the curler body may be collapsed without spoiling the curl formed thereon. In the context of the invention, the term "plunger" means not only a solid bar or similarly formed slide, but generally any means for actuating the expanding and collapsing mechanisms provided inside the curler body. Thus, a guide based on a Bowden control cable for adjusting the circumference of the curler body is intended to fall within the scope of meaning of the term "plunger."

Preferably, the plunger has a position inside the curler body which it assumes automatically or when hair is being wound on, as the result of which the curler body is at its largest diameter. This means that, in practice, a curl can never be wound on a curler body which is at its minimal diameter, at which state it could not be separated from the curler body after drying without unwinding. The above-mentioned preferred position which the plunger occupies in the curler body may be obtained by an elastic restoring force acting on the plunger and may be secured by joining the holding strap and the plunger in such a way that, when the holding strap is fastened, the plunger is automatically held in the position in which the curler body is at its maximum diameter.

According to another aspect of the invention, the hair curler comprises a curler body which is designed to be twisted into the hair and which is made up of a plurality of bar lamellae axially parallel to one another and to the longitudinal axis of the curler in the curling position, which lamellae comprise a cylinder when taken in combination. The curler body comprises means cooperating with the plunger lying in the longitudinal axis of the curler for varying the circumference of the curler body. To simplify production, the bar lamellae preferably are formed integrally at one end with one end of the plunger through at least one film hinge (web) and the opposite (free) ends of the bar lamellae comprise means for engagement in a position on the circumference of the plunger. As used herein, a "film hinge" or "web" is defined as a hinge of a flexible material, generally a thin membrane, which is preferably formed integrally with the elements it joins. A curler body such as this may be made in one piece or in two pieces by injection molding and is very easy to set up or arrange. A hair curler of this type may be made in one piece if, during injection molding, the bar lamellae are turned through 180° out of the working position into a position antiparallel to the longitudinal axis of the curler and are brought into engagement with one another or with the plunger at the free longitudinal end thereof. Thus, this embodiment may be considered similar to a closed umbrella frame, in which the plunger is the shaft and the lamellae are the ribs.

The hair curler may also be made in two parts by injection molding if one part comprises the plunger and the integrally formed bar lamellae and the other part comprises a catch for the free ends of the bar lamellae to be fitted onto the free end of the plunger. The catch to be fitted onto the free end of the plunger may also serve as an actuating button for the longitudinal displacement of the plunger in the assembled hair curler.

Finally, the distribution of material where the curler is made in two parts by injection molding may also be such that the bar lamellae are integrally formed via film hinges with a substantially circular disc which is designed to be connected to an end coupling associated with the disc of a plunger separately made by injection molding. In this arrangement, the free longitudinal ends of the bar lamellae remote from the disc may then be anchored in the working position in an engagement head at the opposite longitudinal end of the plunger.

In the last three embodiments described above, the curler body may be made entirely by injection molding in one or two parts and assembled in a few steps to form the finished curler. The means for increasing or reducing the circumference of the curler body may be commonly expanding elements of an inner cone integrally formed with the inner surface of each of the bar lamellae in such a way that a cup or umbrella integrally formed radially with the plunger and associated with the inner cone can be collapsed and expanded by displacement of the plunger longitudinally of the curler relative to the bar lamellae. The relative longitudinal displacement of the plunger and the bar lamellae and the expansion and contraction of the curler body is made possible by the Webs, preferably provided in pairs at the longitudinal ends of the bar lamellae.

BRIEF DESCRIPTION OF THE DRAWINGS

Examples of embodiments of the invention are described in detail in the following with reference to the accompanying drawings, wherein:

FIGS. 1*a* and 1*b* shows a curler body of variable circumference with expansion by means of a plunger and ball, both in longitudinal section and in cross-section.

FIG. 2 shows the curler body of FIG. 1 in the expanded position.

FIG. 3 shows a variation of the plunger and ball of FIGS. 1 and 2 in which the holding strap is directly connected to one end of the plunger.

FIG. 7 shows a hinged curler in its open position.

FIG. 8 shows a double-cone plunger for insertion in the curler body shown in FIG. 7.

FIG. 9 shows the curler body of FIGS. 7 and 8 in the position of maximum circumference.

FIG. 10 shows the curler body of FIG. 9 with its circumference reduced.

FIG. 17 is a longitudinal section through a curler body comprising inwardly folding walls and with adjustment of the circumference by rotation of an axial cam spindle, the curler body being shown in the position of maximum circumference.

FIG. 18 shows the curler body of FIG. 17 from outside in the position of minimum circumference.

FIG. 19 shows an end view of FIG. 17.

FIG. 19*a* shows a section on the line XIX—XIX.

FIG. 20 shows an end view of FIG. 18.

FIG. 20*a* shows a section on the line XX—XX.

FIG. 35 is a section through an expanded, asembled hair curler of the type shown in FIGS. 33 and 34.

FIGS. 36 and 37 are sections on the lines XXXVI—XXXVI and XXXVII—XXXVII of FIG. 35.

FIG. 38 is a longitudinal section through a collapsed hair curler of the type shown in FIG. 35.

FIG. 39 is a plan view of the curler of FIG. 38.

FIG. 42 is a longitudinal section through an assembled and expanded hair curler of the type shown in FIGS. 40 and 41.

FIGS. 43 and 44 are sections on the lines XLIII—XLIII and XLIV—XLIV of FIG. 42.

FIG. 45 is a longitudinal section through a collapsed hair curler of the type shown in FIG. 42.

FIG. 46 is a plan view of the curler of FIG. 45.

DETAILED DESCRIPTION OF THE INVENTION

Figure 4A:
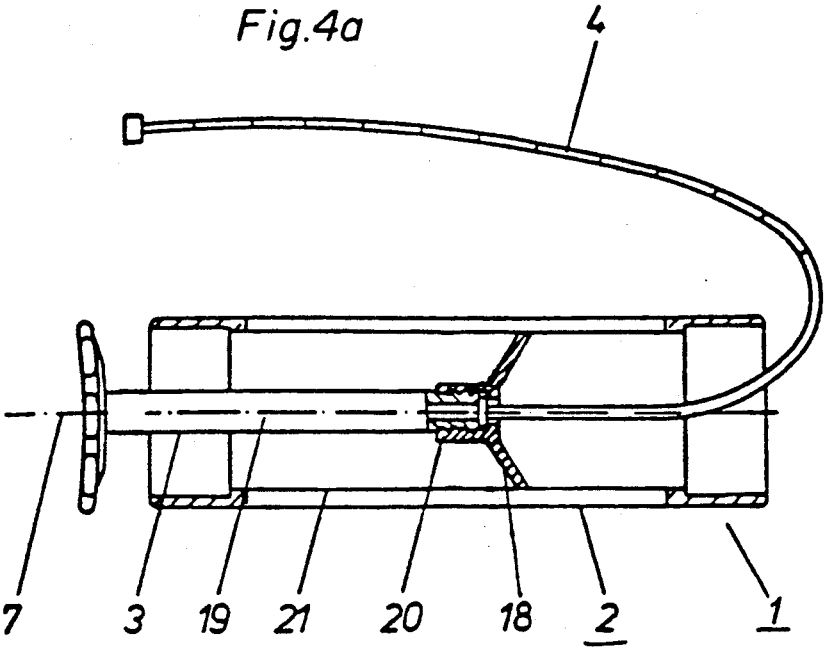
FIGS. 4*a* and 4*b* are a longitudinal section and cross-section through a curler body with expansion by a cup lamella.

The hair curler globally denoted by the reference 1 in FIGS. 1 and 2 comprises a basically cylindrical curler body 2, a plunger 3 longitudinally displaceable (along axis 7) therein and a holding strap 4. After the hair has been wound on, the holding strap 4 is fastened to the longitudinal ends 5 and 6 of the curler body 2. The curler body 2 may comprise individual bar lamellae 8 which extend longitudinally of the curler and which are peripherally held together loosely and/or elastically. For example, the bar lamellae 8 may be arranged on the inside of an outer skin 9 of an elastic rubber or plastic material. The outer skin 9 may have ventilation openings 10.

The plunger 3 guided in the curler body 2 comprises at least one actuating button 11, 12 at at least one longitudinal end. In the embodiment of the curler shown in FIGS. 1 to 3, a ball 13 substantially symmetrical to the central axis 7 of the curler body 2 extending longitudinally of the curler is fixedly mounted on the plunger 3. At the same time, the inner surface of the curler body is formed in sections as an inner cone 14 with inner and outer stop surfaces 15 and 16 for the ball 13 adjoining its two ends. The dimensions of the arrangement are such that, when the ball 13 is disposed on the inner stop surface 16 of smaller internal diameter, the curler body 2 is expanded and, when the ball 13 is disposed on the outer stop surface 15 of larger internal diameter, the curler body 2 is reduced in circumference. The two positions of the ball 13 and, accordingly, the two curler positions corresponding to minimum and maximum diameter are shown for comparison in FIGS. 1 and 2.

The holding strap 4 for fixing the hair wound on the curler 1 may be connected in basically any way to the longitudinal ends 5 and 6 of the curler body 2. It can be of advantage to attach the holding strap 4, in particular integrally, to one end 17 of the plunger 3, as shown in FIG. 3. The holding strap 4 is preferably attached to the longitudinal end 17 of the plunger to be pulled for expansion of the curler body 2. As a result, when the holding strap 4 is tightened, the plunger 3 (and in this embodiment the ball 13 arranged thereon) is automatically drawn into the position shown in FIG. 2 in which the curler body has its maximum diameter.

Figure 4B:
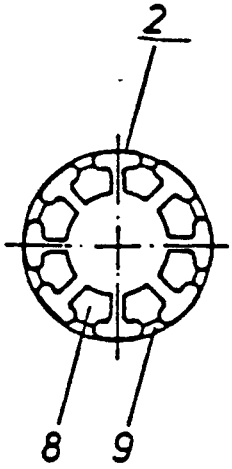
Figure 5:
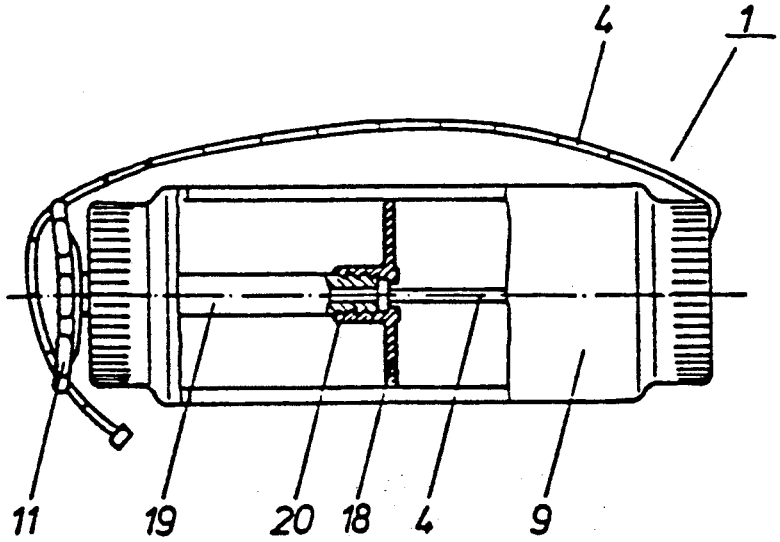
FIG. 5 shows the curler body of FIG. 4 in the position of maximum diameter.

In the embodiment shown in FIGS. 4 and 5, the plunger 3 is no longer connected to a ball 13 co-operating with an inner cone 14 of the curler body 2, but instead to a lamella cup 18 (similar to an umbrella) which is designed to be radially collapsed as shown in FIG. 4 or spread open as shown in FIG. 5 by actuation of the plunger 3. In this case, the plunger 3 may be in the form of a guide 19 in which a form of Bowden cable 20 may be moved in the longitudinal direction 7 by pulling or depressing the actuation button 11. The lamella cup may be fixedly connected to the guide 19 and/or to the inner surface 21 of the curler body 2 (in the latter case, at least in sections), and may be oriented in either axial direction. In the embodiment shown in FIGS. 4 and 5, the curler body 2 may again consist of longitudinally extending (around axis 7) bar lamellae 8 with an elastic outer skin 9 preferably stretched thereover.

The curler body may also be expanded or collapsed by other mechanical means than those shown in FIGS. 1 to 5. For example, it may be expanded and collapsed by way of an oblique plane. In addition, the curler body itself, instead of individual longitudinally extending lamellae, may also consist of a cylinder with a longitudinal gap, of two separate half-shells, of three third-shells, or four quarter-shells, etc. Where there are more than two shell components, the shells are best joined by hinges, apart possibly from a single dividing line. Some embodiments are described in the following with reference to FIGS. 6 to 25.

Figure 6:
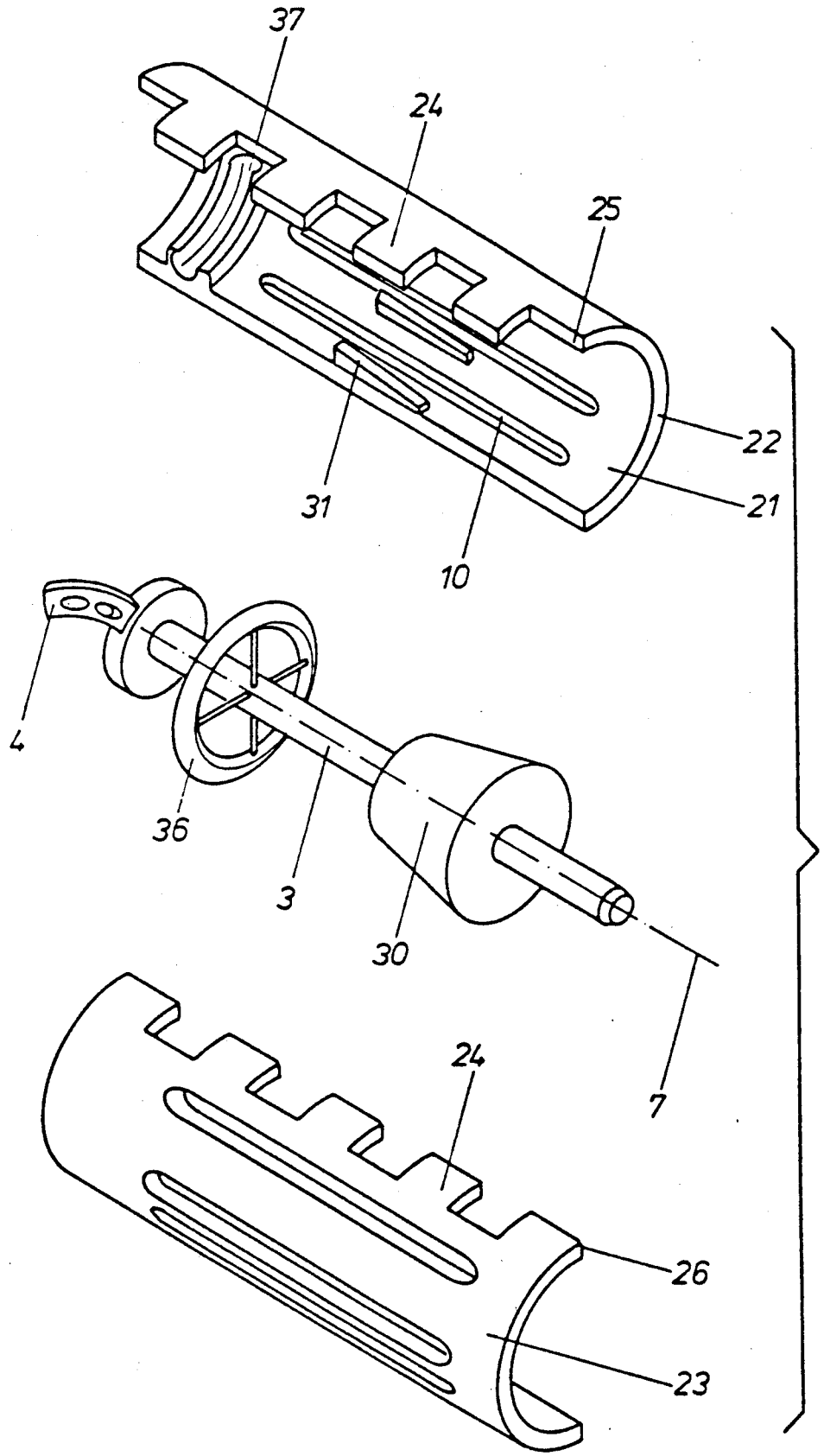
FIG. 6 is an exploded view of a cone-expanded curler body consisting of two rigid half-shells.
Figure 11:
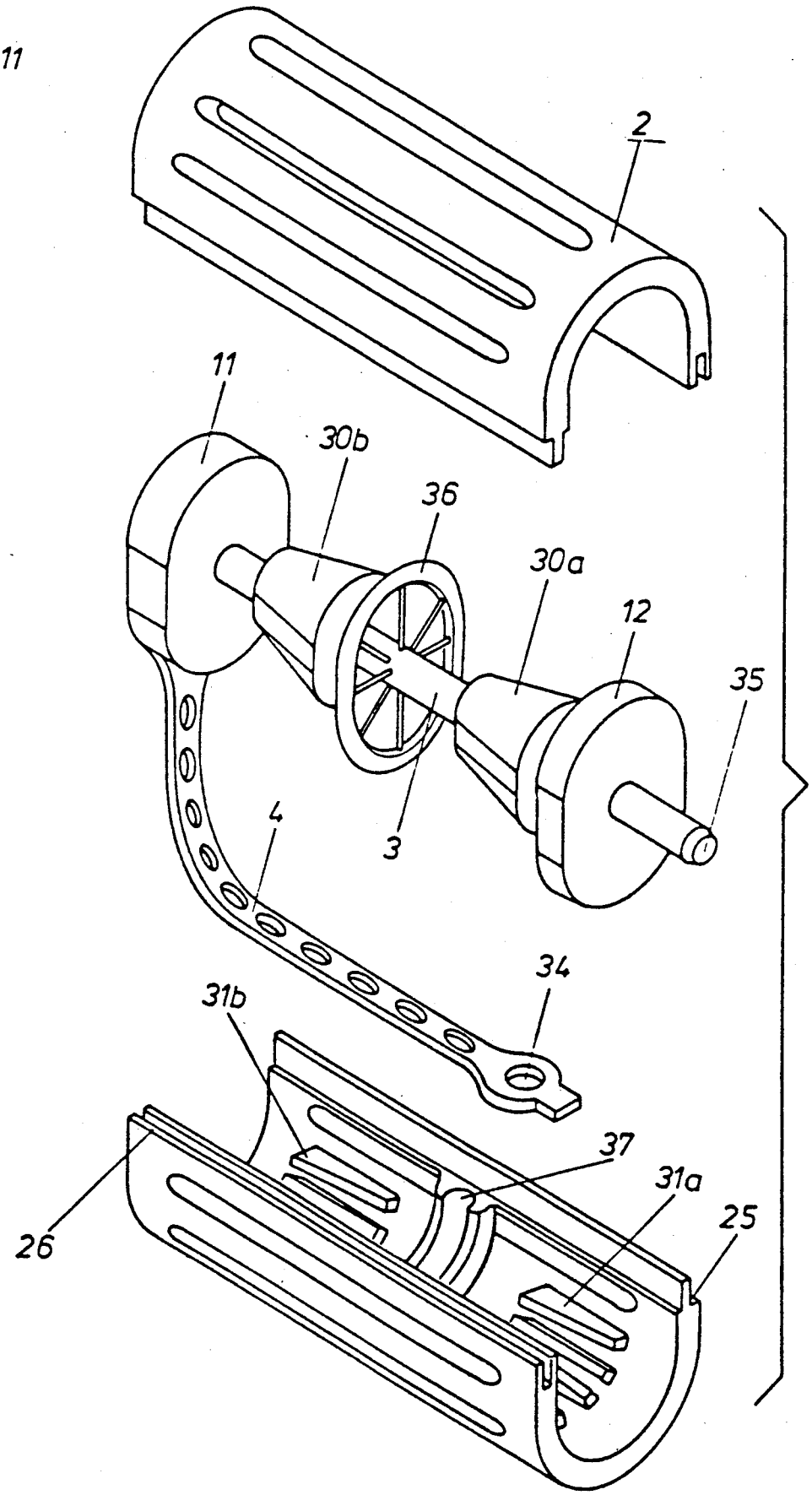
FIG. 11 is an exploded view of a curler body modified in relation to FIG. 6 and expanded by a double cone, having tongue-and-groove joints without a hinge.
Figure 12:
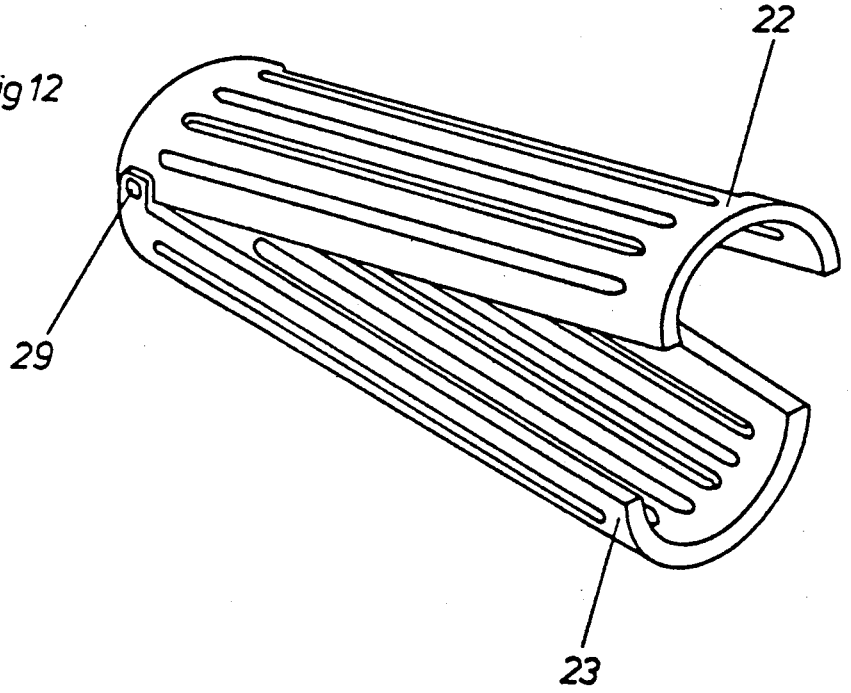
FIG. 12 shows a curler body designed to hinge about a transversely or radially extending axis at one end.
Figure 13:
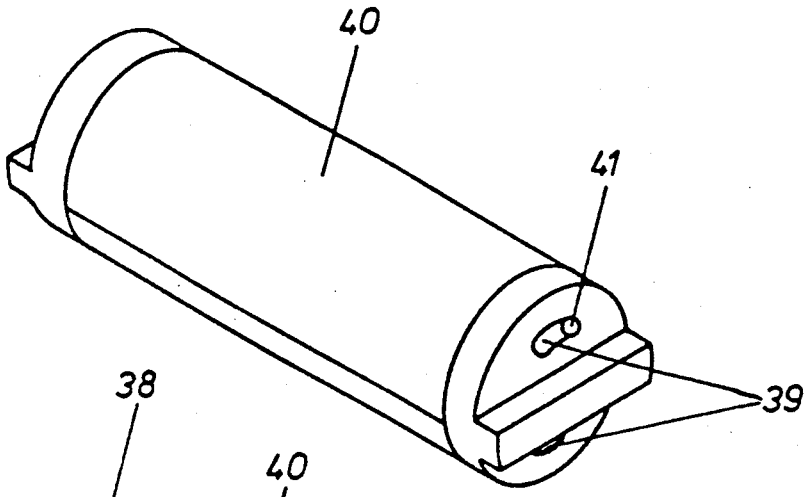
FIGS. 13 and 14 show a curler body of rigid part-shells comprising adjustment studs at the ends of the cylinder in the positions of minimum and maximum circumference.
Figure 14:
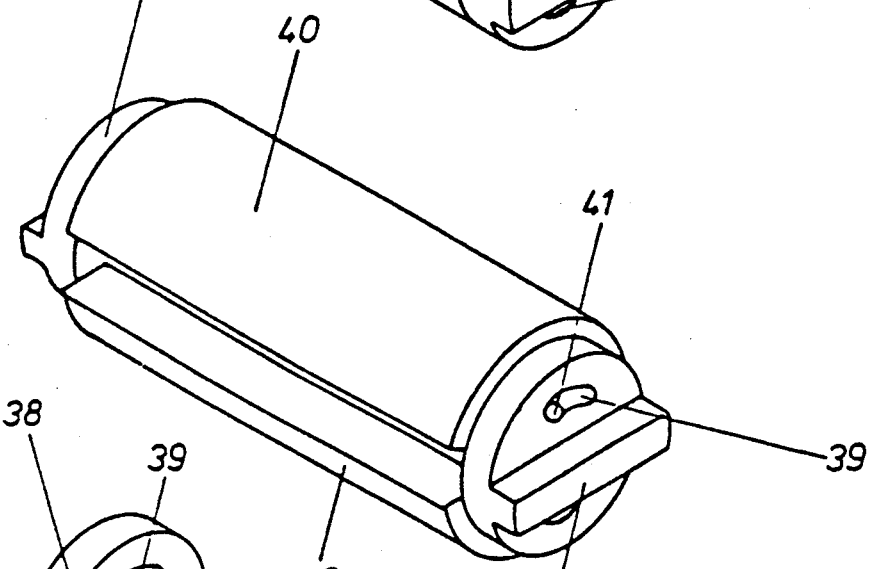
Figure 15:
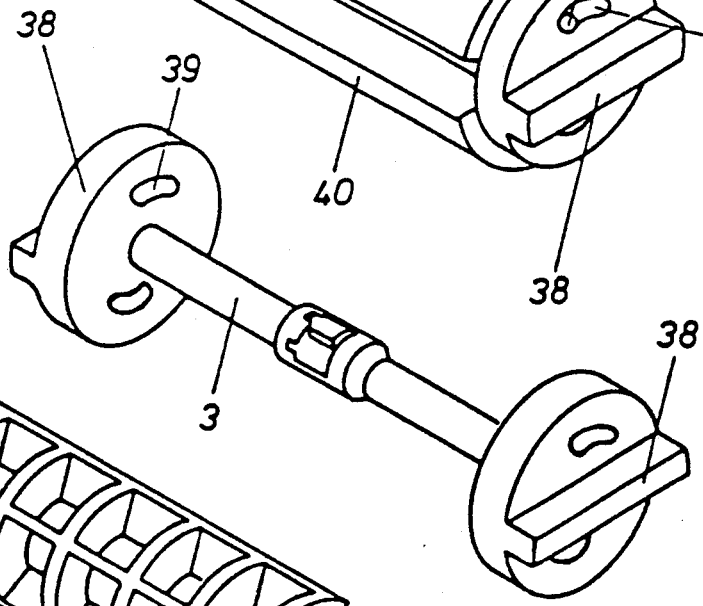
FIG. 15 shows a spindle for use in the curler of FIGS. 13 and 14.
Figure 16:
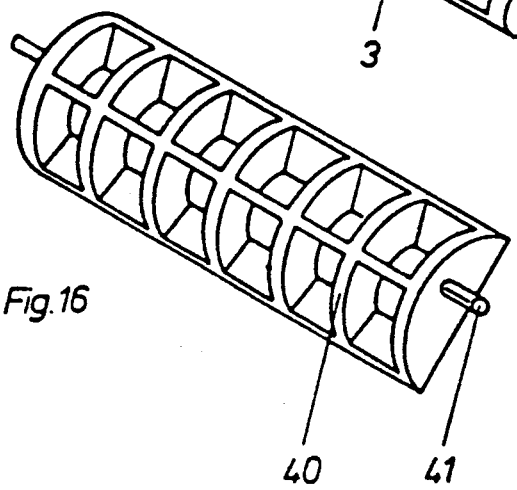
FIG. 16 shows a variant part-shell for use in the curler of FIGS. 13 and 14 designed to cooperate with the spindle of FIG. 15.
Figure 21:
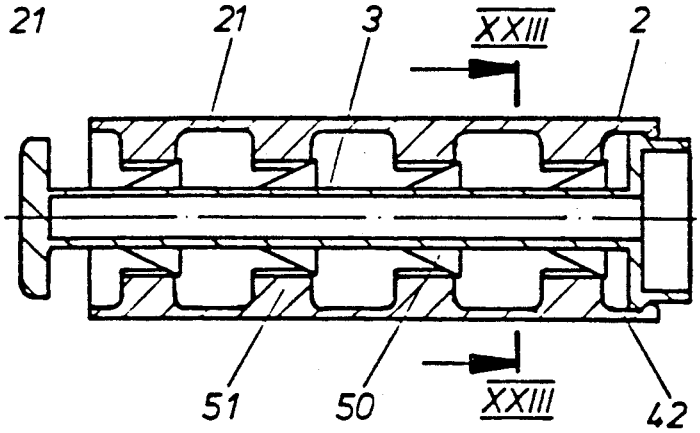
FIG. 21 shows a curler body with inwardly folding walls in the position of maximum circumference.
Figure 23:
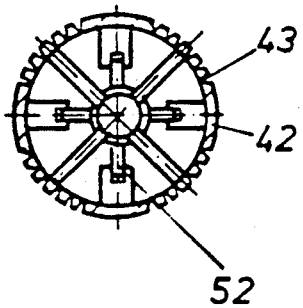
FIG. 23 is a section on the line XXIII—XXIII of FIG. 21.
Figure 22:
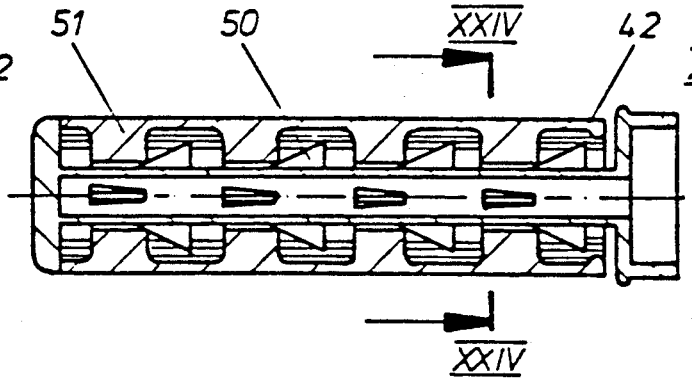
FIG. 22 is a section through the curler body of FIG. 21 after adjustment to minimum circumference.
Figure 24:
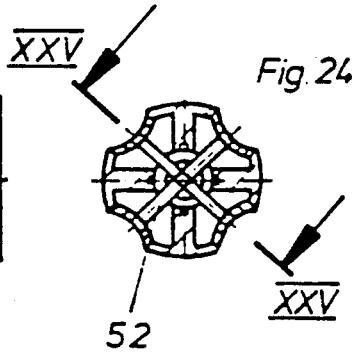
FIG. 24 is a section on the line XXIV—XXIV of FIG. 22.
Figure 25:
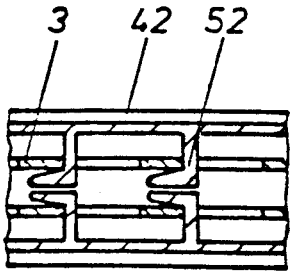
FIG. 25 is a section on the line XXV—XXV of FIG. 24.

The curler body shown in FIG. 6 comprises two half-shells 22 and 23 which, in use, engage more or less deeply with one another via teeth 24. As shown in FIG. 7, instead of the teeth 24, a hinge 27 may be provided on one side and, optionally, locating pins 28 on the other side along the dividing lines 25 and 26 of the half shells 22 and 23. Finally, the dividing lines 25 and 26 may be tongue-and-grooved, as shown in FIG. 11. The type of disengageable joint (i.e. teeth in FIG. 6, pin-and-hole in FIG. 7, tongue-and-groove in FIG. 11) is not critical, although those shown are preferred. Types of useful disengageable joints include, but are not limited to: butt, dovetail, bayonet, rabbet, rabbet-and-dodo, rabbet-and-miter, doweled butt, mortise-and-tenon, mesh, tongue-and-groove, pin-and-hole, and the like. Where hinges are used to join the part-shells of the curler body 2, two half shells 22, 23 may be joined by a hinge or hinges 29 extending transversely, i.e. radially at one end of the curler, as shown in FIG. 12.

Finally, the hinges — in one or more parts — joining the part-shells may also be designed in such a way that, to collapse the hair curler, individual longitudinal strips of the curler casing may be folded inwards so that the periphery of the curler body at the longitudinal strips in question assumes the appearance of a trough.

In the embodiments shown in FIGS. 6 to 11, various forms and configurations of actual or notional cones are used for varying the circumference of the curler body. According to FIG. 6, the plunger 3 comprises a cone 30 arranged coaxially in relation to the longitudinal axis 7 of the curler body. Associated with this cone 30 is a complementary inner notional cone or taper 31 which is coaxial with the inner surface 21 of the curler body. The cones, above all the inner cone, may consist of lamellae shaped to match the shape of the curler body 2 and any openings 10 formed therein.

Instead of the inner cone, the embodiment shown in FIG. 7 comprises a two-piece circular ring 32 which is fixed to the inner surface 21 of the particular half-shell 22, 23 perpendicularly to the central axis and of which the bore 33 corresponds to the smaller diameters of the associated double cone 30 attached to the plunger 3. When the plunger 3 according to FIG. 8 is inserted into the curler body 2 shown in FIG. 7 and the curler body is closed via the hinge 27, the circumference of the curler body may be expanded (FIG. 9) or contracted (FIG. 10) by depressing one or the other actuation button 11,12 of the plunger 3. The embodiment shown in FIG. 8 comprises a double cone through which it is possible to reduce the circumference of the curler body twisted into the hair by applying pressure to one or the other longitudinal end thereof.

The internal mechanics of the hair curler shown in an exploded view in FIG. 11 are basically the same as in the embodiment shown in FIG. 6. There is a difference in that, instead of one cone 30, there are two concurrent cones 30*a* and 30*b* (outer cones on the plunger) to which correspond notional inner cones 31*a* and 31*b* on the inner surface of the particular half shell of the curler body 2. In the embodiment shown in FIG. 11, the holding strap 4 is attached to that longitudinal end of the plunger 3 which has to be withdrawn from the interior of the curler to expand the curler body. The holding strap 4 may be fastened to the other longitudinal end of the plunger 3 via an eye 34 engaging over a hook 35, or the like, on the actuation button 12. In the embodiment of FIG. 11, the curler is expanded by pushing actuation button 12 and contracted by pushing actuation button 11. The use of concurrent cones 30*a*, 30*b*, permits a more uniform expansion of the curler body 2 along its central axis 7 (not shown in this figure). As a further variation, the cylindrical body and/or the complementary cones may be extended in a direction perpendicualr to the central axis, so that their perpendicualr planar configuration is expanded from circular to ellipsoidal. In this instance, expansion and reduction of the curler is preferably along a line passing through both foci of the ellipse.

In the embodiments shown in FIGS. 6 and 11, the plunger 3 is surrounded by a ring 36 comprising rubber or other elastic material which is elastically fastenned thereto, the ring 36 engaging in an annular groove 37 in the inner surface 21 of the particular part-shell of the curler body 2. The annular groove 37 is preferably deeper in the radial direction than the magnitude of the maximum change in diameter envisaged for the curler body 2. The function of the ring 36 is to act like a washer spring which will always return the plunger 3 to its original or normal position. In general, the original position selected is that position in which the hair curler is at its maximum diameter. This ensures that, when twisted into the hair, the curler is always at its largest diameter and may be changed from its original position into a position of reduced diameter merely by displacing the plunger 3 or other actuating element.

FIGS. 13 to 16 show a hair curler in which the circumference is varied through slots 39 provided in discs 38 attached to the longitudinal ends of a spindle 3*a*. Studs or pins 41 fixedly connected to (or integral with) the part-shells 40 of the curler engage in the slots 39. Since the slots 39 are distinctly oblique, for example inclined through 30° to 60° in relation to the circle described by the studs when the spindle 3*a* is rotated about its notional longitudinal axis so as to form a spiral in a plane perpendicular to the notional axis, expansion or contraction of the curler body 2 is obtained by turning the spindle relative to the curler casing, about their common notional axis.

The curler casing of the hair curler shown in FIGS. 17 to 20 and 21 to 25 comprises longitudinally extending part-shells 42 joined to one another in one piece by multi-part film hinges 43, about a common notional axis. The parts abutting one another at the periphery of the casing may be fixedly, i.e. non-releasably, joined to one another along a dividing line possibly emanating from manufacture. In these embodiments, the curler body is collapsed by radially contracting the part-shells or film hinges.

In the embodiment shown in FIGS. 17 to 20*a*, the spindle 3*a* rotatable about its longitudinal axis 7 has a cross-section in the form of a cam star 44. Countercams 46 are associated with the individual cams 45 of the star 44 on the inner surface 21 of the curler body 2 in such a way that, in the position of maximum curler circumference, the cams 45, 46 stand tip-to-tip (as shown in FIG. 19*a*) while, in the position of minimum circumference, the counter-cams 46 engage in the shoulders 47 between the cams 46 of the star 44 (as shown in FIG. 20*a*). As in the embodiment shown in FIGS. 13 to 16, the actuation button 11 in FIGS. 17 and 18 may be provided with slots 48 in which engage studs 49 projecting from each part shell of the curler body 2.

In FIGS. 21 to 25, oblique plane cams 50 defining a notional outer cone are provided on plunger 3 and abutment cams 51 defining a notional inner cone co-operating therewith are provided on the inner surface 21 of the curler body, for expanding and collapsing the curler body in the same way as in FIGS. 6 to 11. As can be seen in particular from FIGS. 24 and 25, the contraction of the part-shells 42 optionally supported by the cams 50/51 is accompanied by lowering of a support 52 for the film hinges 43, i.e. the support 52 is pressed into the interior of the plunger 3.

Features of the hair curler which are particularly favorable to their production in one piece in two parts by injection molding will now be described with reference to the embodiments illustrated in FIGS. 26 to 46. All these curlers may be expanded and collapsed and provided with a holding strap in basically the same way as in the previous embodiments. The embodiment shown in FIGS. 1 to 3 in particular may advantageously be produced on the principle described in the following.

Figure 26:
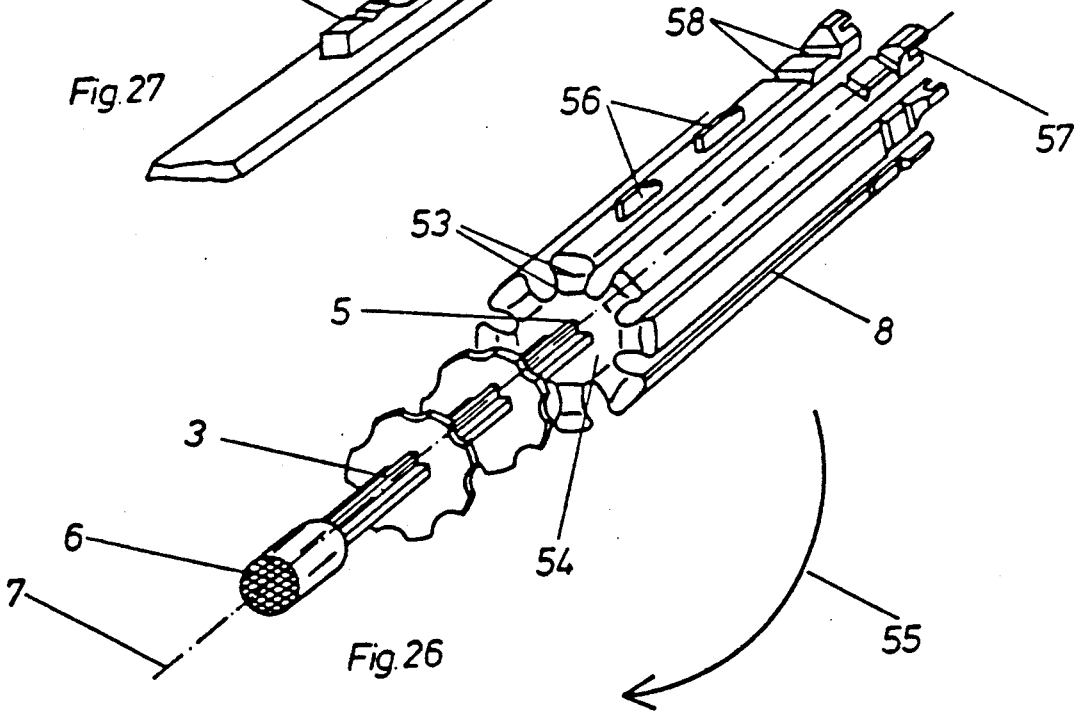
FIG. 26 is a perspective view of a curler blank intended to be made by injection molding in which the lamellae are to be folded 180°.

FIG. 26 shows a typical hair curler which may be injection-molded in one piece. To convert the workpiece of FIG. 26 to a hair curler, each lamella 8 is folded 180° radially to the central axis 7, through hinge 53 connected to plunger end 5, until the lamellae 8 form a cylinder about central axis 7 with plunger 3 at its center (see FIGS. 28 and 31).

Figure 28:
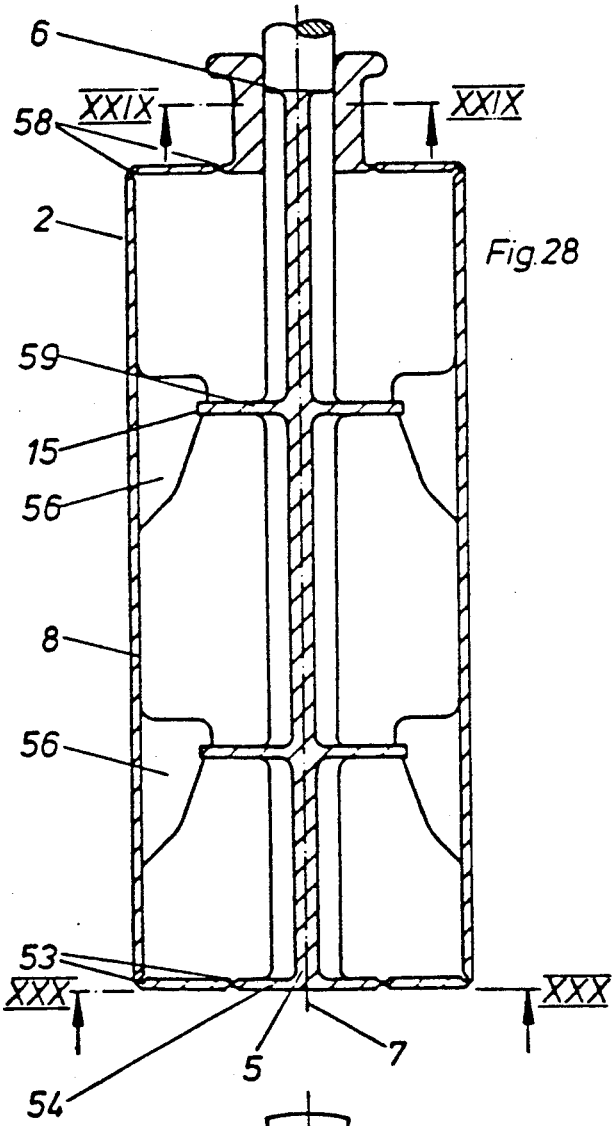
FIG. 28 is a longitudinal section through the hair curler of FIG. 26 in the expanded position.
Figures 33, 34:
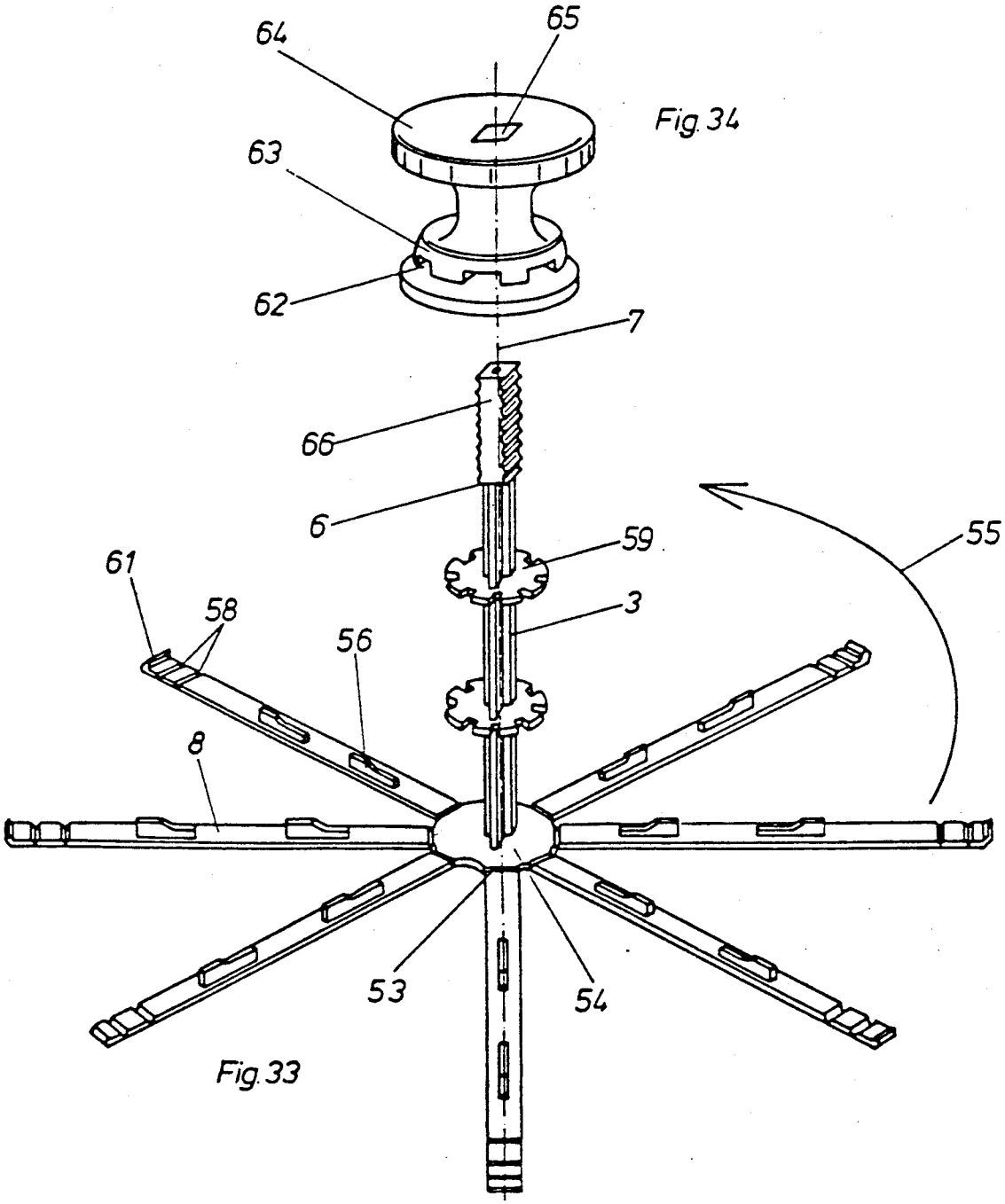
FIGS. 33 and 34 are perspective views of the two parts of a two-part blank of a hair curler intended to be made by injection molding.

As shown in FIGS. 26, 28 and 33, among others, the bar lamellae are connected to the plunger 3 or rather to a disc 54 formed integrally with its longitudinal end 5. In the position shown in FIG. 26, in which the entire curler body may be directly injection-molded, the means associated with the bar lamellae 8, particularly the cone elements (abutments) 56, are situated on the outside of the bar lamellae 8. To simplify the drawing, only a few cone elements 56 are diagrammatically illustrated in FIG. 26.

Figure 27:
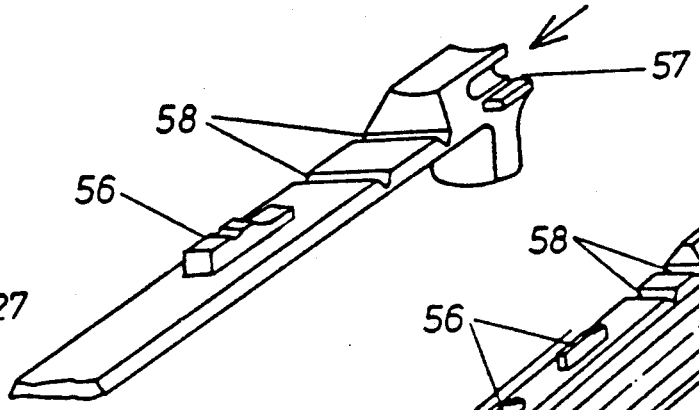
FIG. 27 is a view on a larger scale of a free end piece of a bar lamella of FIG. 26.

The free end piece of a bar lamella 8 is shown in perspective on a larger scale in FIG. 27. The longitudinal ends of the bar lamellae 8 in FIGS. 26 and 27, on the side edges facing the particular adjacent lamella, comprise tongues and grooves 57 which enable the free longitudinal ends of the bar lamellae 8, after being folded 180° in the direction of the arrow 55 into the working position, to engage in one another circularly around the plunger 3 in such a way that the free ends of the bar lamellae 8 surround the longitudinal end 6 of the plunger 3 as a fixed ring displaceably relative to the plunger. For the mobility of the bar lamellae 8 relative to the plunger 3, the bar lamella 3 has two additional film hinges 58 adjoining the free end.

Figure 29:
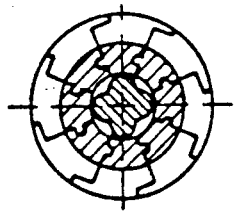
FIG. 29 is a section on the line XXIX—XXIX of FIG. 28.
Figure 30:
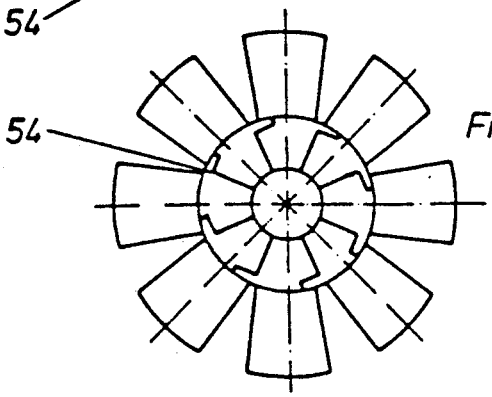
FIG. 30 is an elevation of the expanded curler of FIG. 28 in the direction of the line XXX—XXX.
Figure 32:
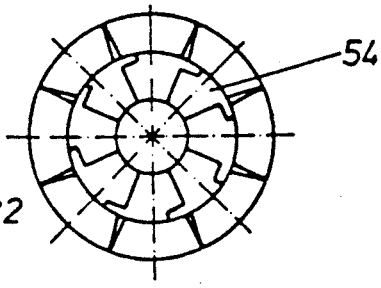
FIG. 32 is a plan view of the curler of FIG. 31.

It will now be explained with reference to FIGS. 29 to 32 how a hair curler produced from the blank shown in FIG. 26 may be operated in practice. First, after the bar lamellae 8 have been folded into the working position and the free longitudinal ends of the bar lamellae 8 have been coupled in one another around the periphery of the free longitudinal end 6 of the plunger 3, the curler body is expanded in basically the same way as shown in FIGS. 1 and 2 by displacing the plunger 3 comprising radial cups 59 around its periphery along the longitudinal axis 7 of the curler so that the cups 59 move into the upper engagement stop 15 of the cone elements 56. As shown in FIGS. 29 and 30, the film hinges 53 and 58 situated nearer the plunger 3 are then stretched while the double film hinges 53 and 58 situated further from the plunger 3 are bent approaching 90° for each pair.

Figure 31:
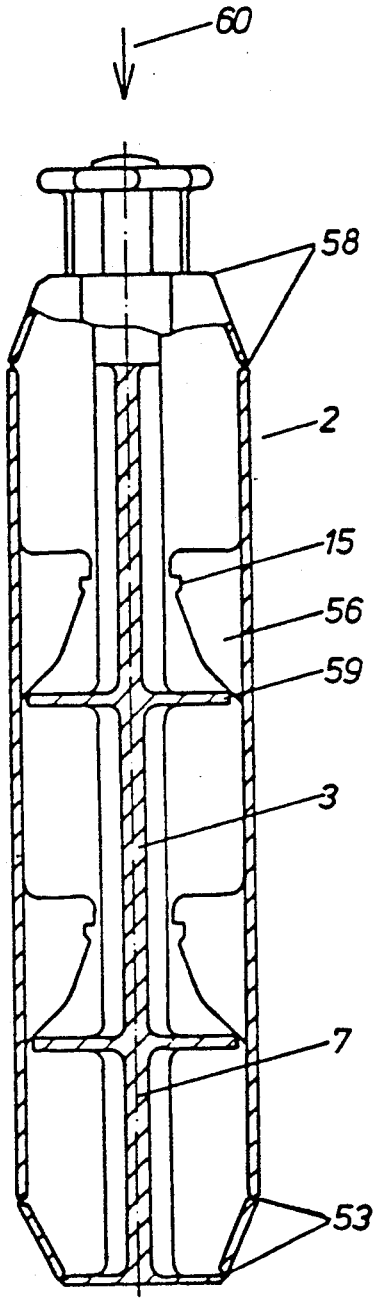
FIG. 31 is a longitudinal section through a collapsed hair curler of the type shown in FIG. 28.

This relative position changes when, as shown in FIG. 31, the plunger 3 is depressed in the direction 60 so that the cups 59 are disengaged from the upper stop 15 of the cone elements 56. Since the entire curler body 2 is simultaneously stretched parallel to the longitudinal axis 7 by the displacement of the plunger 3 in the direction 60, the film hinges 53 and 58 adjacent the plunger 3 are bent and the other film hinges 53 and 58 are stretched to a more or less considerable degree. The radius of the curler body 2 is thus reduced substantially by the distance between adjacent film hinges 53 and 58; the ratio involved can be seen for example by comparing FIGS. 30 and 32.

The hair curler may also be made in two parts by injection molding. Examples of two embodiments are described in the following with reference to FIGS. 33 to 39 and 40 to 46.

According to FIG. 33, the curler body produced directly by injection molding consists of bar lamellae 8 projecting substantially radially in the shape of a star from the plunger 3 or rather from a disc 54 attached to the longitudinal end 5 thereof (as in FIG. 26). As in FIGS. 26 and 27, these bar lamellae are provided over their length with one, two or more cone pieces 56 corresponding to the cup 59 surrounding the plunger 3. Double film hinges 53 extending parallel to one another are again provided at the boundary between the disc 54 and the bar lamellae 8.

As in the embodiment shown in FIGS. 26 to 32, double film hinges 58 extending parallel to one another are also formed at the free longitudinal end of the bar lamellae 8. The longitudinal ends of the bar lamellae 8 themselves are in the form of detent pins 61 designed to engage in detent holes 62 in a detent element 63, preferably with an actuation button 64, designed to be slidably fitted onto the free end 6 of the plunger 3. Accordingly, to prepare the hair curler shown in FIGS. 35 and 38 for use, the bar lamellae merely have to be folded about 90° in the direction of the arrow 55 until they are parallel to the longitudinal axis 7 of the curler body 3.

This position and the operation of the curler body 2 thus positioned are described in the following with reference to FIGS. 35 to 39. As in the embodiment shown in FIGS. 28 to 32, the curler body 2 may be expanded and collapsed by longitudinal displacement of the plunger 3 in the direction 60. The difference between the two embodiments lies above all in the way in which the free ends of the bar lamellae 8 are coupled. For the plunger 3 to be effectively guided in the associated longitudinal opening 65 of the actuation button 64, it is best to provide a square profile here as shown in FIG. 36 both for the longitudinal end 66 of the plunger 3 and also for the opening 65 of the actuation button 64. As for the rest, FIGS. 35 to 39 correspond to FIGS. 29 to 32 in that order.

Figure 40:
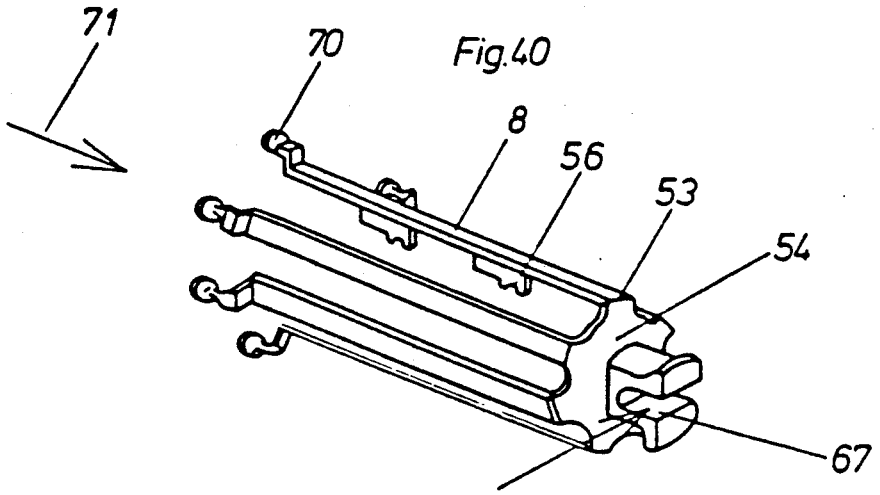
FIGS. 40 and 41 are perspective views of a modified embodiment in relation to FIGS. 33 and 34 of a two-part curler blank intended to be made by injection molding.
Figure 41:
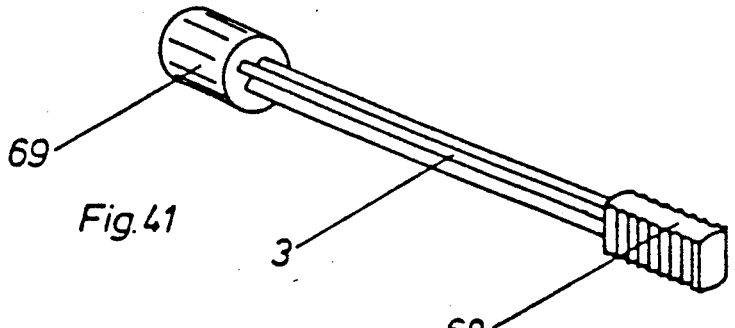
Figure 41A:
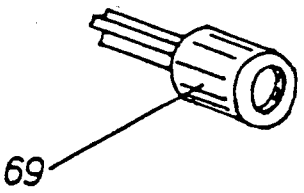
FIG. 41*a* is a detail of FIG. 41.

The other hair curler which can be made in two parts by injection molding is described in the following with reference to FIGS. 40 to 46. In this case, one part which may be directly formed by injection molding comprises — as shown in FIG. 40 — the bar lamellae 8, for example with cone pieces 56, and a disc 54 holding the bar lamellae 8 together via film hinges 53 with an insertion guide 67 for insertion of the plunger 3 to be separately produced as shown in FIG. 41. At one end, the plunger 3 comprises a key 68 for the insertion guide 67 and, at its other end, a coupling element 69 for the engagement of detent cams 70 provided at the longitudinal end of each of the bar lamellae 8. For assembly, the plunger 3 with the key 68 at the front is inserted in the direction of the arrow 71 into the cylindrical cage expanded by the bar lamellae 8 in FIG. 40, and the key 68 passes through a complementary hole (not shown) in insertion guide 67.

In this embodiment, two film hinges 53 and 58 extending parallel to one another are provided at either end of each bar lamella 8. Likewise, the plunger 3 is equipped with radial cups 59 (not shown in FIG. 41) co-operating with the cone elements 56. The embodiment shown in FIGS. 42 to 46 substantially corresponds to the features of the embodiments shown in FIGS. 28 to 32 and 35 to 39 apart from the way in which the bar lamellae 8 are joined to the plunger 3 (connection 69/70). Accordingly, the drawing is self-explanatory. Preferably, connection 69/70 is designed so that once detent cams 70 are bent and inserted into the detent cam received of coupling element 69 (in the manner shown in FIGS. 42 and 44), the cams 70 are not easily removable. This may be accomplished in known manner by use of a friction- or click-fit joint, an 0-ring, adhesive, or an end cap. Similarly, the detent pins 61 may be retained in the detent holes 62 in the embodiment shown in FIGS. 33, 34, in the above known manner. Furthermore, the ends of the lamellae which are joined to form a ring, as shown in FIGS. 27–32, may be retained in the above known manner.

We claim:

1. A hair curler comprising:

A) a hollow radially expandable and contractible, generally cylindrical curler body with a notational longitudinal central axis;

B) a detachable holding strap stretching from one longitudinal end of said body to the other;

C) expansion actuation means including:

1) a plunger adapted for longitudinal motion, coaxial with and within said body projecting longitudinally from at least one end of said body, 2) biasing means comprising at least one element inside the curler body cooperating between said plunger and said cylindrical body, so that said body will expand upon the application of bias generated by said plunger moving longitudinally in one direction, and contract upon removal of said such bias via longitudinal movement of said plunger in an opposite direction back to its original position; and 3) said biasing means including at least one cup lamella which projects outwardly from said plunger and whose free end biases against the inner surface of said curler body, a hinge connecting said cup lamella to said plunger, said lamella being at an acute angle to said plunger, and being cup-shaped when said curler body is contracted, and is swung on said hinge by the longitudinal movement of said plunger until it is perpendicular to said plunger to expand said curler body.

2. A hair curler comprising:

A) a hollow radially expandable and contractible, generally cylindrical curler body with a notational longitudinal central axis;

B) a detachable holding strap stretching from one longitudinal end of said body to the other;

C) expansion actuation means including:

1) a plunger adapted for longitudinal motion, coaxial with and within said body projecting longitudinally from at least one end of said body, 2) biasing means comprising at least one element inside the curler body cooperating between said plunger and said cylindrical body, so that said body will expand upon the application of bias generated by said plunger moving longitudinally in one direction, and contract upon removal of said such bias via longitudinal movement of said plunger in an opposite direction back to its original position, 3) said biasing means including on said plunger at least one coaxial, outwardly expanding, solid cone, and including on said curler body complementary ramp elements projecting inward from its inner surface, which ramp elements generally define a complementary ramp cone for each solid cone on said plunger, so that each solid cone biases against a complementary ramp cone upon longitudinal displacement of said plunger to expand said curler body, and 4) wherein a washer spring is provided to return said plunger to a position in which said curler body is expanded, after it has been longitudinally displaced to effect contraction of said curler body, said spring comprising a flexible coaxial ring fixed on said plunger and closely seated in an annular groove on the inner surface of said curler body, and said annular groove being deeper in the radial direction than the maximum change in diameter upon expansion of said curler body.

3. A hair curler comprising:

A) a hollow radially expandable and contractible, generally cylindrical curler body with a notational longitudinal central axis;

B) a detachable holding strap stretching from one longitudinal end of said body to the other; and C) expansion actuation means including:

1) a plunger adapted for longitudinal motion, coaxial with and within said body projecting longitudinally from at least one end of said body, 2) biasing means comprising at least one element inside the curler body cooperating between said plunger and said cylindrical body, so that said body will expand upon the application of bias generated by said plunger moving longitudinally in one direction, and contract upon removal of said such bias via longitudinal movement of said plunger in an opposite direction back to its original position, 3) said plunger including at least one radially outwardly projecting element that is adapted to bias against at least one complementary inwardly projecting element on the inner surface of said cylinder which projects radially inward, upon longitudinal displacement of said plunger, said at least one outwardly projecting element serving as said biasing means, and 4) wherein said one outwardly extending element is comprised of rigid coaxial double solid cones, said cones being jointed at their widest points and having opposed tapers; and wherein said inwardly projecting element comprises a rigid annulus whose hole is large enough only to permit longitudinal passage of said plunger; so that one of said cones biases against the hole of said annulus upon longitudinal displacement of said plunger resulting in the expansion of said curler body.

4. A hair curler comprising:

A) a hollow radially expandable and contractible, generally cylindrical curler body with a notional longitudinal central axis;

B) a detachable holding strap stretching from one longitudinal end of said body to the other; and C) expansion actuation means including:

1) a plunger adapted for longitudinal motion, coaxial with and within said body projecting longitudinally from at least one end of said body, 2) biasing means comprising at least one element inside the curler body cooperating between said plunger and said cylindrical body, so that said body will expand upon the application of bias generated by said plunger moving longitudinally in one direction, and contract upon removal of said such bias via longitudinal movement of said plunger in an opposite direction back to its original position;

3) said plunger including at least one outwardly projecting element which projects radially outward and is adapted to bias against at least one complementary inward element on the inner surface of said cylinder which projects radially inward, upon longitudinal displacement of said plunger, said at least one outwardly projecting element serving as said biasing means;

4) said outwardly projecting element on said plunger being comprised of at least one sphere whose center is on said central axis, and whose size and location is sufficient to engage and bias against said inward element upon longitudinal motion of said plunger;

5) said inward element defining a first cylindrical stop with a diameter greater than any sphere, a cone tapering from said cylindrical stop to a diameter smaller than said sphere, and a second cylindrical stop with a diameter smaller than said sphere, so that when said plunger is displaced longitudinally in the direction of said second stop, the sphere passes through said cone and rests in said second stop, while biasing radially outward and expanding said curler body; and D) said holding strap being permanently fixed to that end of said plunger which is closest to said second stop, and is detachably fixed to the other end of said plunger, and wherein said other end comprises an actuation button.

* * * * *